US007849608B2

(12) United States Patent
Turatti

(10) Patent No.: US 7,849,608 B2
(45) Date of Patent: Dec. 14, 2010

(54) APPARATUS FOR DRYING LEAF PRODUCTS

(75) Inventor: Antonio Turatti, Cavarzere (IT)

(73) Assignee: Turatti S.R.L., Cavarzere, VE (IT)

( * ) Notice: Subject to any disclaimer, the term of this patent is extended or adjusted under 35 U.S.C. 154(b) by 510 days.

(21) Appl. No.: 11/625,388

(22) Filed: Jan. 22, 2007

(65) Prior Publication Data

US 2007/0172564 A1 Jul. 26, 2007

(30) Foreign Application Priority Data

Jan. 23, 2006 (IT) ..... RM2006A0027

(51) Int. Cl.
*F26B 17/24* (2006.01)
*F26B 17/30* (2006.01)

(52) U.S. Cl. ..... 34/58; 34/312; 34/318; 34/322

(58) Field of Classification Search ..... 34/58, 34/59, 312, 313, 317, 318, 322, 328, 665, 34/172; 426/489, 231; 198/377.01, 377.02, 198/377.04, 375, 397.02, 762, 750.1, 750.14, 198/750.8, 764; 53/464
See application file for complete search history.

(56) References Cited

U.S. PATENT DOCUMENTS 2,705,070 A * 3/1955 Carrier, Jr. et al. ..... 198/763
2,963,140 A * 12/1960 Barton ..... 118/418
3,227,263 A * 1/1966 Kastenbein ..... 198/572
3,257,732 A * 6/1966 Webster ..... 34/318
3,260,030 A * 7/1966 Wach et al. ..... 53/464
3,456,659 A * 7/1969 Tiby ..... 134/153
3,587,203 A * 6/1971 Miles ..... 53/512
3,618,289 A * 11/1971 Wach et al. ..... 53/64
4,278,625 A * 7/1981 Dedolph ..... 264/39
4,493,156 A * 1/1985 Siegmann ..... 34/319
6,170,170 B1 * 1/2001 Van Felius ..... 34/313
6,390,276 B1 * 5/2002 Haug et al. ..... 198/377.01
6,481,117 B2 * 11/2002 Turatti ..... 34/164
6,626,192 B2 * 9/2003 Garcia et al. ..... 134/25.3
2003/0233765 A1 * 12/2003 Heinzen et al. ..... 34/321

* cited by examiner

*Primary Examiner*—Kenneth B Rinehart
*Assistant Examiner*—Corey Hall
(74) *Attorney, Agent, or Firm*—Gauthier & Connors LLP

(57) ABSTRACT

Apparatus for drying leaf products including a product supply or loading section, a product centrifugation and drying section and a dried product discharging section. The loading section comprises a conveyor belt for continuously supplying the entering product and then discharges the collected product on the drying section. The centrifugation and drying section, downward of the supply section comprises a continuous conveyor with two parallel chains on which a plurality of centrifugation baskets is mounted, each one rotating about its own axis. The discharge section, receiving the dried product from the centrifugation section, and transferring the same at the exit, comprises an elevator conveyor belt operated by a motor.

13 Claims, 3 Drawing Sheets

APPARATUS FOR DRYING LEAF PRODUCTS

PRIORITY INFORMATION

This application claims priority to Italian Patent application No. RM2006A000027 filed on Jan. 23, 2006, which is incorporated by reference in its entirety herein.

BACKGROUND OF THE INVENTION

1. Field of the Invention

The present invention relates to an apparatus for drying leaf products. More specifically, the invention concerns an apparatus permitting continuously drying leaf products, such as salad and similar delicate products.

2. Brief Description of the Art

As it is well known, drying steps are provided when processing food products such as leaf products and generally speaking vegetables. To this end, various apparatuses are presently available.

In case it is necessary drying huge amount of product, drying is carried out using heat exchange tunnel systems. This solution has well evident drawbacks, among which the high managing and maintenance costs and the fact that said systems can ruin products, particularly leaf products that are particularly delicate.

Apparatuses are already available on the market in order to overcome these problems.

Main technical problem of this kind of apparatuses is that they have a batch operation mode. In other words, product to be dried, once loaded in the apparatus, is dried by centrifugation and then removed, and then the same cycle is repeated.

In order to overcome this problem, the Applicant has already filed the Italian Patent Application n° RM2002A000032. Said application describes an apparatus mainly comprising an elevator belt for continuously loading the product, a continuous discharge elevator belt, and a centrifugal system.

Main problem of this kind of solution is due to the fact that it creates rather bulky product heaps on the discharge elevator belt, thus creating problems to the following operation along the line.

It is thus evident that these solutions are expensive and require a long time to complete the process.

In view of the above, it is object of the present invention that of suggesting an apparatus for drying delicate leaf products permitting a continuous drying step, with a consequent increase of processing rate of the processing lines providing said apparatus.

SUMMARY OF THE INVENTION

It is therefore specific object of the present invention an apparatus for drying leaf products substantially comprised of a product supply or loading section, of a product centrifugation and drying section and of a dried product discharging section, operatively serially provided each other, wherein loading section comprises a conveyor belt for continuously supplying the entering product P, and a hopper, normally closed at the bottom for collecting the product supplied by the conveyor belt and then discharging the collected product on the drying section, the centrifugation and drying section, downward the collection hopper of the supply section comprises a continuous conveyor with two parallel chains on which a plurality of centrifugation baskets is mounted, each one rotating about its own axis, said transport chains being provided along a closed loop path defining an onward run and a return run, said transport chains being moved by toothed wheels actuated by a motor, as well as by means for conferring to said centrifugation baskets a fast rotary motion about their own axis, the discharge section, receiving the dried product from the centrifugation section, and transferring the same at the exit, comprises an elevator conveyor belt operated by a motor.

In such a structure, each centrifugation basket receives a set amount of said product supplied by said supply means and is sent along a lengthened cyclic circular path along a plane substantially vertical wherein each centrifugation basket makes an onward run, during which the centrifugation occurs, and then it is upturned for discharging the product subjected to treatment and then making the return run.

During centrifugation, product contained within said baskets is pushed against the lateral holed surfaces of the baskets and is substantially dried by the centrifugal force effect caused by said rotation, then falling on said discharge means after the upturning of each centrifugation basket.

Advantageously, according to the invention, said apparatus comprises one or more pushing means acting on said motion transmission means so as to maintain them under a suitable tension, thus increasing the mechanical coupling force.

Preferably, according to the invention, said apparatus comprises a tunnel wherein said centrifugation baskets enter during the rotation about their own axis so as intercepting water ejected from product centrifuged within said baskets, said tunnel comprising lateral drainage for water collection.

Always according to the invention, said apparatus comprises water jets for cleaning said centrifugation baskets, preferably while they are upturned, and thus during the return path of the conveyor on which they are fixed.

In a preferred embodiment, said apparatus comprises a frame, with respect to which said loading conveyor belt can translate, and an articulated system for translating said conveyor belt with respect to said frame, suitable to permit translation of said conveyor belt with an advancement speed substantially corresponding to the advancements speed of said centrifugation baskets and with the same direction of said products, and having also a return speed, said conveyor belt following each centrifugation basket up to its filling by said supply means and going back with said return speed up to the start position, in order to fill in the following basket.

Obviously, advancement and return translation speed of said loading conveyor belt are correlated with the centrifugation belt advancement speed and can be based on the following formula: $V_2=2V_1$.

In a further embodiment according to the invention, said apparatus comprises at least a fan creating one or more air jets for drying and cleaning said centrifugation baskets, preferably when they are upturned.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE INVENTION

Figure 1:
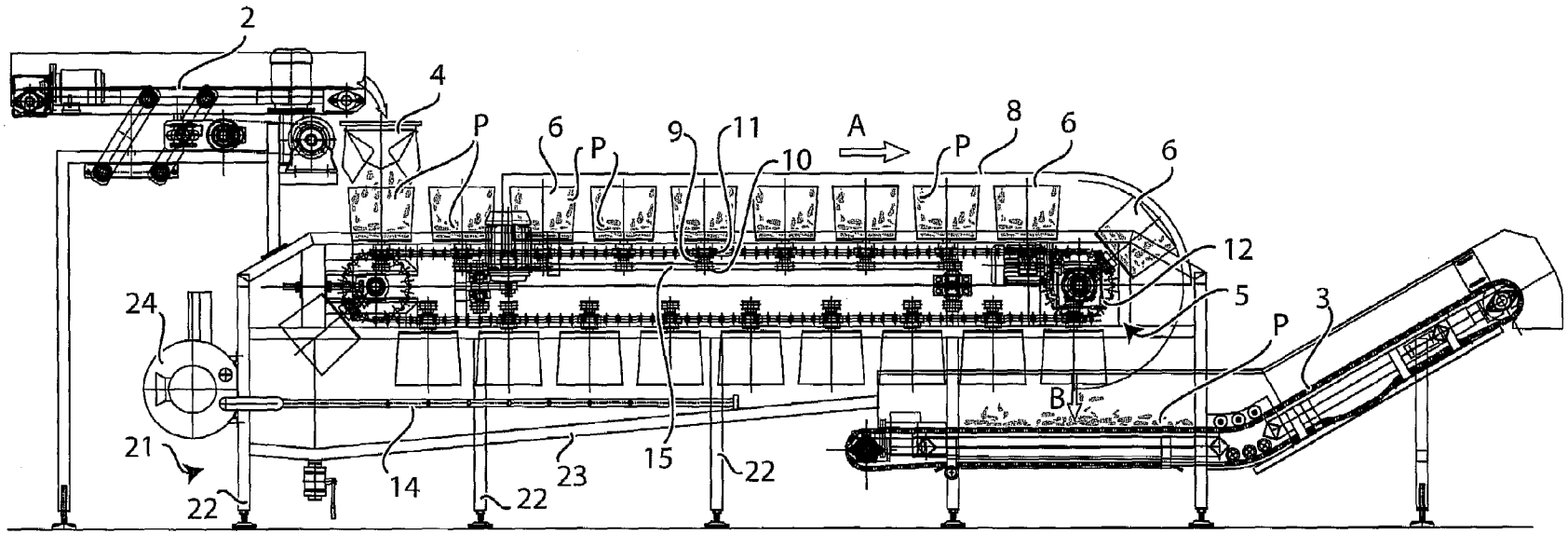
FIG. 1 is a schematic lateral view of an apparatus for drying leaf products.
Figure 2:
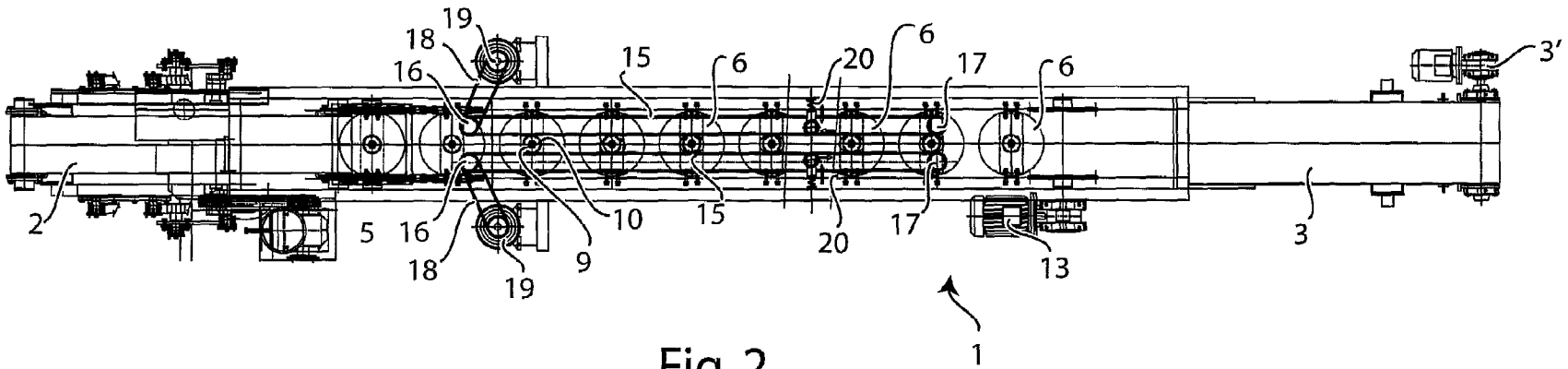
FIG. 2 is a schematic plan view of the apparatus of FIG. 1.

Making reference to FIGS. 1 and 2 it is possible observing a lateral and top view of apparatus 1 for drying leaf products according to the present invention.

Particularly, said apparatus 1 is substantially comprised of a product supply or loading section, of a product centrifugation and drying section and of a dried product discharging section, operatively serially provided each other.

Loading section comprises a belt 2 continuously supplying entering product P (the specific embodiment of which will be better described in the following), and a hopper 4, normally closed at the bottom for collecting the product supplied by the conveyor belt 2, and that can be open when necessary for discharging the collected product on the baskets of the drying section, as it will be described in the following. A motor 25 operates said conveyor belt 2, in a known manner.

Discharge section, receiving the dried product from the centrifugation section, and transferring the same at the exit, comprises an outlet elevator conveyor belt 3 operated by a motor 3'.

Centrifugation and drying section 5 is provided downward the collection hopper 4 of the supply section and comprises a continuous conveyor with two parallel chains 7 on which a plurality of centrifugation baskets 6 is mounted. Particularly, said centrifugation baskets 6, are mounted on said parallel transportation chains 7 so as to rotate each about its own axis, in order to make the centrifugation action. Said transport chains 7 continuously drags centrifugation baskets 6 along a closed loop path defining an onward run, the direction of which is indicated by arrow A, and a return run, both along a vertical plane.

Said transport chains 7 are moved by toothed wheels 12, actuated by a motor 13.

Centrifugation baskets 6 have their lateral surface with holes (centrifugation baskets 6 holes cannot be seen in the figures). While said centrifugation baskets 6 are dragged along said chain conveyor 5, they enter, for a part of the onward run, within a tunnel 8, within which they are rotated at high speed about their own axis. Thus, product P is subjected to a centrifugal force permitting ejection of washing water still on the product. Ejected water exits from holes of said centrifugation baskets 6, while inner walls of said tunnel 8 prevent that the same is spread outside promoting collection and drainage.

At the end of the onward run, centrifugation baskets 6 exit from tunnel 8, are upturned for the return run, discharging product P on the outlet conveyor belt 3, following trajectory B.

Figure 3:
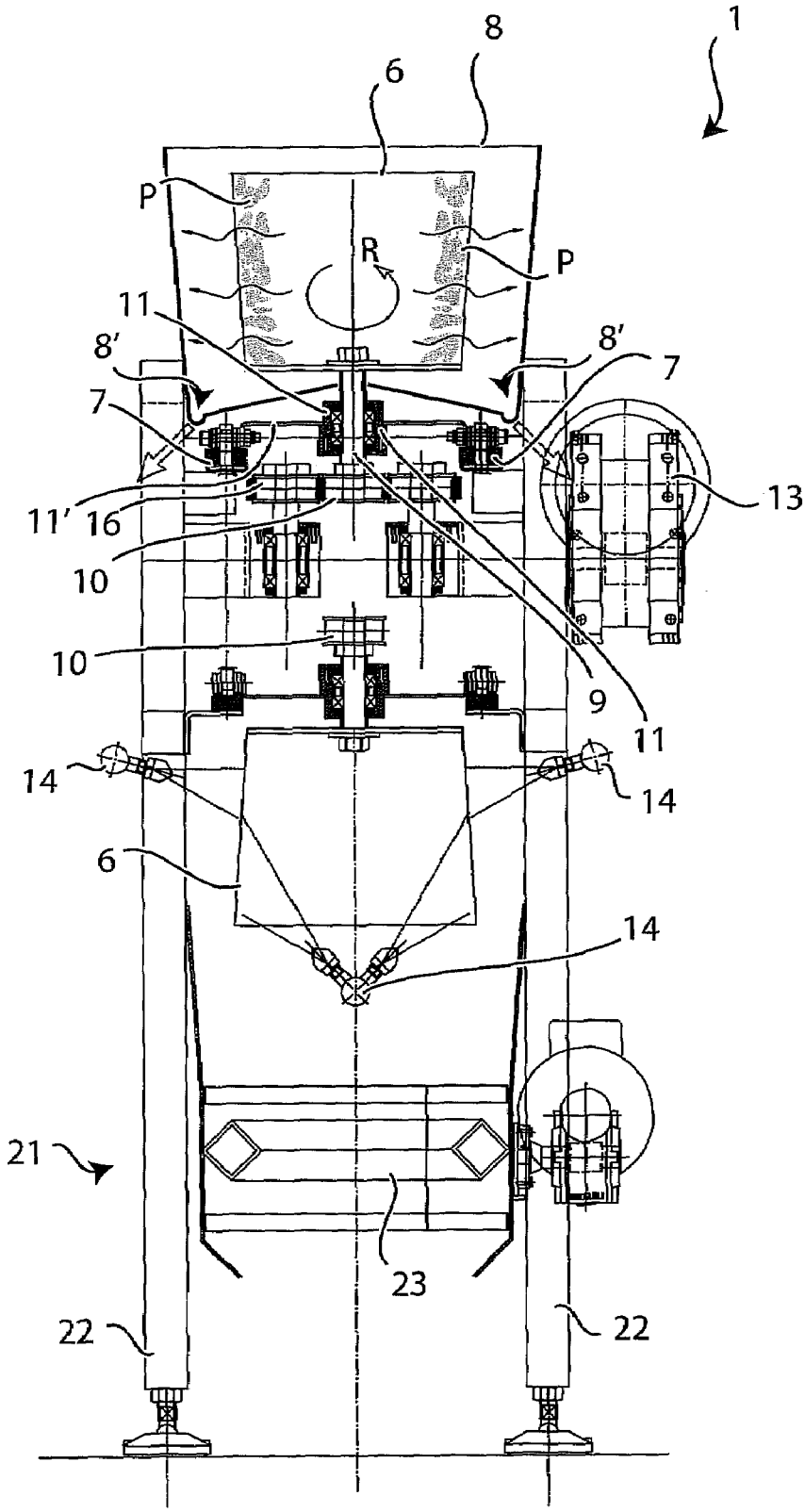
FIG. 3 is a schematic front section view of apparatus of FIG. 1.

As far as centrifugation is concerned, making particular reference to FIG. 3, it can be noted that centrifugation baskets 6 are fixed at the bottom at a shaft 9, at the lower end of which a pulley 10 is fixed. Shaft 9 in inserted and supported in such a way to freely rotate by suitable bearings, within a ring 11, fixed to transverse elements 11', which are bridging provided between said parallel transport chains 7.

Rotation of centrifugation baskets 6 with respect to their own axis occurs by a belt system that can be observed in the plan view of FIG. 2. Particularly, said system comprises a pair of belts 15, realising a closed loop about two pulleys 16 and 17, provided wide-by-side and rotating according to the same direction. Rotation of each belt 15 is obtained since each pulley 16 is rotated by two further belts 18, operated by two motors 19 rotating according to the same direction.

Since rings of the belts are side-by-side and have a very lengthened shape, as clearly shown in the figure, inner part of the chains 15 are paced each other, parallel, and slide in the opposite direction.

Distance between opposed surfaces of the belts 15 exactly correspond to the diameter of pulley 10 fixed at the lower end of the shaft 9 supporting the baskets 6. When each centrifugation basket 6, dragged according to the A direction by said chains 7, passes within said tunnel 8, said pulley 10 enters within the space between the opposed surfaces of said belts 15 and is in contact with the same. Since belts 15 rotates, as already mentioned, in opposed directions, they cause a fast rotation by friction of said pulley 10, and thus each one of said centrifugation baskets 6, thus obtaining centrifugation and ejection of water from product P.

In order to ensure coupling of belts 15 with pulleys 10 of each centrifugation basket 6, apparatus 1 comprises one or more pushing means 20. Said pushing means 20 put belts 15 under tension, thus having a better adhesion to said pulleys 10, creating a higher friction action.

Water jets 14 are provided in the lower portion of apparatus 1, permitting removal of product P residuals from centrifugation baskets 6, before the end of the return path and thus before they are upturned again to be loaded again by hopper 4, and then making another onward run according to arrow A.

At the end of rotation, said centrifugation baskets 6 are also subjected to drying and cleaning by air jets emitted by a fan 24. Jets of air maintained under pressure by different devices can also exert this function.

FIG. 3 shows more clearly coupling described in the above between said pulley 10 and said belts 15, operated by pulleys 16, for rotation of said centrifugation baskets 6.

Particularly, it can be observed that, while centrifugation basket 6 is within tunnel 8, by the above mentioned coupling, it is fast rotated according to direction R, so that water adhering to the product is ejected, exiting through lateral holes and sliding along lateral walls of said tunnel 8, collecting along the lateral drainage 8'.

From the figure it is clearly noted section of ring support 11, with relevant bearings, fixed to the pair of transportation chain pair 7, by bridge transverse means 11'.

In conclusion, shaft 9 is perpendicular with respect to chain 7 sliding direction and is connected, at its upper end, with the centrifugation basket 6, while its lower end is coupled with said pulley 10. The latter, passing between said belts 15, continuously rotating in opposite directions, contacts with them by friction and is rotated at high speed.

FIG. 3 also shows water jets 14 for cleaning centrifugation baskets 6 of product residuals P (leaves, vegetables pieces and like) once upturned and after having laid down the dried product P on the exit elevator belt 3.

Apparatus 1 is mounted on a support structure 21, substantially comprised of vertical axis 22 and beams 23, as it can be easily understood from figures.

Figure 4:
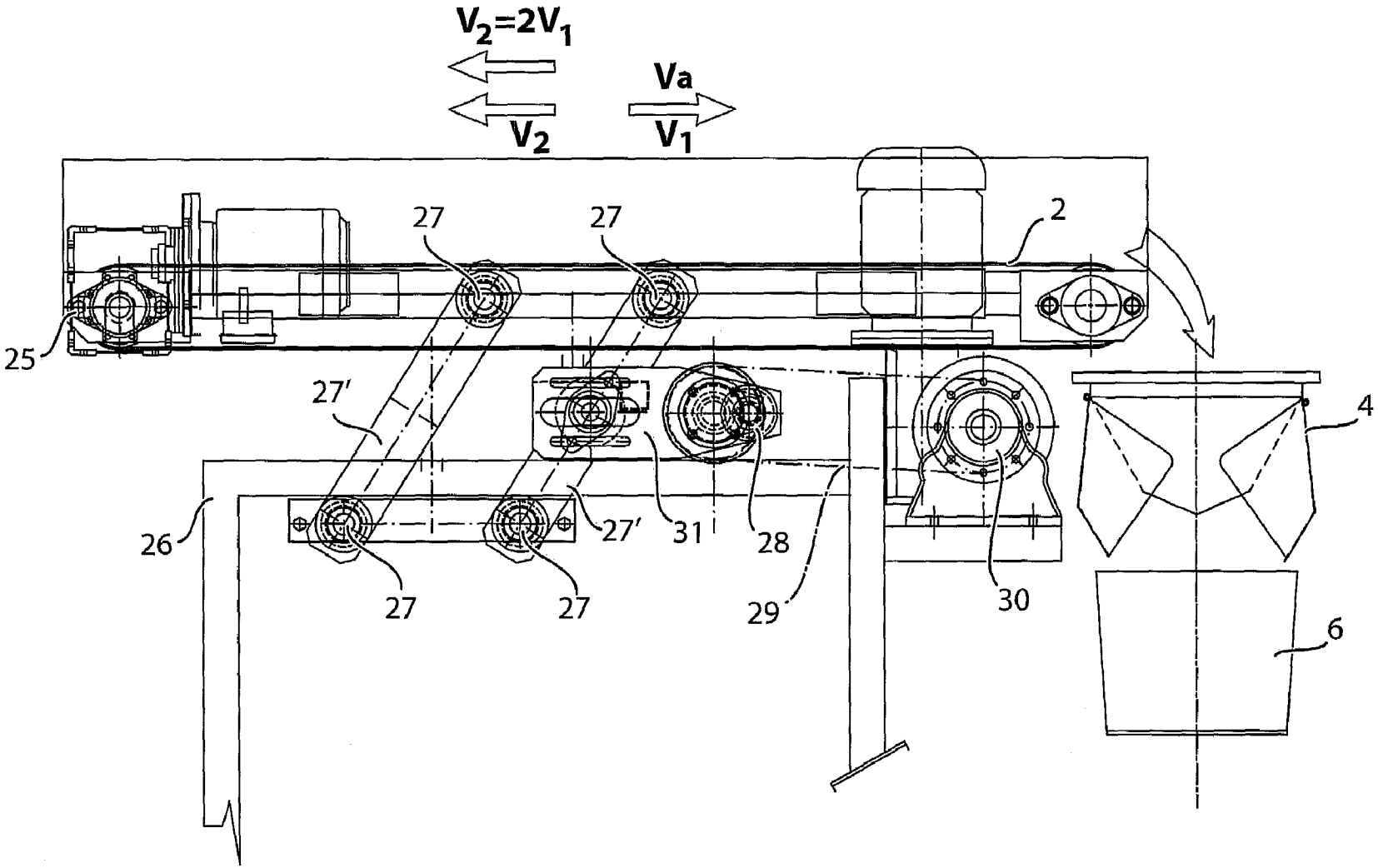
FIG. 4 is a schematic lateral view of an embodiment of a supply system for the leaf products, according to the present invention.

Finally, FIG. 4 shows an embodiment of the conveyor belt 2 for continuously supplying product P, suitable to properly fill in centrifugation baskets 6 by hopper 4. Said conveyor belt 2 is provided with a particular cyclic motion permitting following each centrifugation basket 6 with the same speed up to the full filling and then going back quickly to the start position, to then continue filling each following centrifugation basket 6.

Particularly, said conveyor belt 2 is powered by motor 25 and is mounted on fixed frame 26 by two parallel rods 27', pivoted about pins 17 between fixed frame 26 and conveyor belt 2, so as to realise an articulated parallelogram structure permitting to the conveyor belt 2 moving with respect to the fixed frame and horizontally sliding with a reciprocating motion according to the product advancement direction and to the opposite one, respectively.

An eccentric 28, powered by a motor 30 through a belt 29, obtains horizontal reciprocating motion. Rotation of said eccentric 28 is transmitted by a connecting rod 31 directly to one of the rods 27 of the articulated parallelogram permitting said reciprocating movement of said conveyor belt 2 according to the product advancement direction and according to the return run, respectively, as described in the above. Obviously, those skilled in the art can easily understand that conveyor belt 2 can be mounted on each sliding support and that motor 30 movement can be transmitted to the conveyor belt 2 by any equivalent mechanical system suitable to transform the rotatory motion of the motor 30 into reciprocating motion of conveyor belt 2.

Translation speed $V_1$ of conveyor belt 2 according to the product advancement direction must obviously be synchronised with that of centrifugation baskets 6, while return translation speed $V_2$ must be higher than the previous one, of an amount depending on the distance between centre of centrifugation baskets 6, so that for each complete cycle of conveyor belt 2, hopper 4 is always under a centrifugation basket 6. in the present embodiment, return translation speed $V_2$ is double with respect to the translation speed $V_1$($V_2$=2$V_1$).

On the basis of the previous specification, it can be noted that one of the basic features of the present invention is that system permits at the same time dragging and rotation of a container with respect to its own axis.

An advantage of the present invention is that of permitting drying vegetables and generally speaking leaves without interrupting dragging flow, permitting designing and realising working lines much more efficient.

The present invention has been described for illustrative but not limitative purposes, according to its preferred embodiments, but it is to be understood that modifications and/or changes can be introduced by those skilled in the art without departing from the relevant scope as defined in the enclosed claims.

What is claimed is:

1. An apparatus for drying leaf products substantially comprised of a product supply or loading section, of a product centrifugation and drying section and of a dried product discharging section, operatively serially provided each other, wherein the loading section comprises a conveyor belt for continuously supplying an entering product of individual moist leaves, operated by a motor and a hopper, normally closed at the bottom for collecting the product supplied by the conveyor belt and then discharging the collected product on the drying section, the centrifugation and drying section, downward the collection hopper of the supply section comprises a continuous conveyor with two parallel chains on which a plurality of centrifugation baskets is mounted, each one rotating about its own axis, said transport chains being provided along a closed loop path defining an onward run and a return run, said transport chains being moved by toothed wheels actuated by a motor, as well as by means for conferring to said centrifugation baskets a fast rotary motion about their own axis such that there is more than one basket centrifuging individual leaves at the same time, the discharge section, receiving the dried product of individual leaves from the centrifugation section, and transferring the same at the exit, comprises an elevator conveyor belt operated by a motor.

2. The apparatus according to claim 1, wherein said centrifugation baskets have their lateral surface provided with holes.

3. The apparatus according to claim 1, wherein said centrifugation baskets are fixed at the bottom at a shaft, at the lower end of which a pulley is fixed, and said shaft is inserted and supported in such a way to freely rotate by suitable bearings, within a ring, fixed to transverse elements, which are bridging provided between said parallel transport chains.

4. The apparatus according to claim 1, wherein said means for conferring to said centrifugation baskets a fast rotary motion about their own axis comprises a pair of belts, realizing a closed loop about two pulleys, provided side-by-side and rotating according to the same direction by two further belts, operated by two motors rotating according to the same direction.

5. The apparatus according to claim 1, wherein rings of the belts are side-by-side and have a very lengthened shape, inner part of the belts are faced each other, parallel, and slide in the opposite direction.

6. The apparatus according to claim 1, wherein a tunnel is provided about part of the onward run of said transport chain supporting said centrifugation baskets, the inner walls of said tunnel collecting water ejected from the holes of said centrifugation baskets and to convey the same toward suitable lateral drainage.

7. The apparatus according to claim 3, wherein distance between opposed surfaces of the belts exactly correspond to the diameter of pulley fixed at the lower end of the shaft supporting the baskets, and said belts are so placed that, when each centrifugation basket, dragged by said chains, passes within a tunnel, said pulley enters within the space between the opposed surfaces of said belts and engages dragging the same.

8. The apparatus according to claim 1, wherein said conveyor belt is slidably mounted on a fixed frame and it is provided with a cyclic motion system comprising a motor and of a horizontal reciprocating motion transmission system to transform the rotary motion of the motor into reciprocating motion of said conveyor belt.

9. The apparatus according to claim 8, wherein said conveyor belt is mounted on fixed frame by two parallel rods, pivoted about pins between the fixed frame and the conveyor belt, so as to realize an articulated parallelogram structure permitting to the conveyor belt moving with respect to the fixed frame and horizontally sliding with a reciprocating motion according to the product advancement direction and to the opposite one, respectively.

10. The apparatus according to claim 8, wherein horizontal reciprocating motion is obtained by an eccentric, powered by a motor through a belt, rotation of said eccentric is transmitted by a connecting rod directly to one of the rods of an articulated parallelogram.

11. The apparatus according to claim 1, wherein said apparatus comprises one or more pushing means acting on said belts so as to exert tension, thus increasing mechanical coupling force.

12. The apparatus according to claim 1, wherein said apparatus comprises water jets for cleaning said centrifugation baskets, provided under the apparatus before the end of the return run.

13. The apparatus according to claim 1, wherein it comprises a fan for drying and cleaning said centrifugation baskets provided before the beginning of their onward run.

* * * * *